US006679729B2

(12) United States Patent
Tanaka et al.

(10) Patent No.: US 6,679,729 B2
(45) Date of Patent: Jan. 20, 2004

(54) CONNECTOR

(75) Inventors: Nobuyoshi Tanaka, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/235,588

(22) Filed: Sep. 5, 2002

(65) Prior Publication Data

US 2003/0228794 A1 Dec. 11, 2003

(30) Foreign Application Priority Data

Nov. 6, 2002 (JP) ..... 2001-340749

(51) Int. Cl.[7] ..... H01R 13/422
(52) U.S. Cl. ..... 439/595
(58) Field of Search ..... 439/595, 752, 439/680

(56) References Cited

U.S. PATENT DOCUMENTS 6,276,964 B1 * 8/2001 Shinozaki ..... 439/595
6,334,790 B2 * 1/2002 Kashiyama et al. ..... 439/595
6,341,985 B2 * 1/2002 Kodama ..... 439/595
6,375,502 B2 * 4/2002 Yoshida et al. ..... 439/595

OTHER PUBLICATIONS

Japan Institute of Invention and Innovation (JIII) Journal of Technical Disclosure No. 98–6297.

* cited by examiner

*Primary Examiner*—Gary Paumen
(74) *Attorney, Agent, or Firm*—Gerald E. Hespos; Anthony J. Carella

(57) ABSTRACT

A housing (31) has cavities (32A), and a lance for locking terminal fittings (20) in the cavities (32A). A region of a lower wall (33) of the housing (31) forward from the lance (37) is formed as an open part (38). Thus, it is possible to make the entire lower wall (33) thin, and the housing (31) can be inserted into a smaller through-hole (19). A rib (39) projects between the open parts (38) of adjacent cavities (32A) and (32A) to increase a distance water would have to creep between the cavities (32A) and (32A). Therefore if a connector (30) is exposed to water, it is possible to prevent a short circuit between the cavities (32A) and (32A).

6 Claims, 7 Drawing Sheets

CONNECTOR

BACKGROUND OF THE INVENTION

1. Field of the Invention

The present invention relates to a connector for use in a two-wheeled vehicle and the like.

2. Description of the Related Art

Two-wheeled automotive vehicles, such as motorcycles and motor scooters, are provided with external lights, such as turn indicators (i.e. blinkers or winkers), emergency flashers, parking lights and such. Similar lights are provided on other vehicles, such as three-wheeled or four-wheeled all terrain vehicles. A light for such a vehicle has a lamp and terminal fittings are connected to ends of electric wires taken out from the body of the lamp. The terminal fittings are accommodated in a connector, and the connector is connected to a mating connector disposed on the vehicle body. In this way, both connectors become electrically conductive to each other. FIGS. 7 and 8 show a conventional connector of this kind. The connector has a long narrow rectangular housing 1 made of a synthetic resin. The housing 1 has opposite front and rear ends and three cavities 2A, 2A, and 2B that extend between the front and rear ends. The cavities 2A, 2A and 2B are configured to accommodate the terminal fittings (not shown). The cavities 2A and 2A are arranged side by side along a lower wall 4 of the housing 1, while the cavity 2B is formed on an upper portion of the housing 1. The upper cavity 2B is oriented sideways with respect to the lower cavities 2A and 2A, as shown in FIG. 8. A cantilevered lance 3 is formed inside each of the cavities 2A and 2B, and functions to lock the terminal fittings in the respective cavities 2A, 2A and 2B. A drawing opening 5 extends from the front of the lance 3 to the front end of the housing 1 for drawing a die during the molding of the housing 1. Portions of the lower wall 4 of the housing 1 near the base of the lance 3 are thick, whereas the portion of the lower wall 4 forward from the lance 3 are comparatively thin and cover the periphery of the drawing opening 5.

The connector for the blinker of an automatic two-wheeled vehicle is disclosed in a journal of technical disclosure 98-6297.

The body of the lamp of the blinker is fixed to the body of the vehicle through a lamp holder. The body of the lamp is mounted on the body of the vehicle by inserting the above-described connector into a circular through-hole 6 of the lamp holder, as shown in FIG. 8. The connector then is connected to the mating connector disposed on the vehicle body. Recent designs of the blinker have tended to reduce the inner diameter of the through-hole 6. Accordingly there is a demand for a compact connector housing so that the connector can be inserted into the smaller through-hole of the lamp holder.

The present invention has been made in view of the above-described problem. Accordingly, it is an object of the present invention to provide a compact connector that can be inserted into a small through-hole.

SUMMARY OF THE INVENTION

The invention is directed to a connector with a housing that has a cavity capable of accommodating a terminal fitting. An elastically or resiliently deflectable lance is formed in the cavity along an inner side of the outer wall of the housing, and is configured to lock a terminal fitting in the cavity. A region of the outer wall forward from the lance is open. Accordingly, the entire lower wall of the housing can be thinner than that of a conventional lower wall, and the housing can be inserted into the smaller through-hole.

The housing preferably is configured for insertion into a circular through-hole along an insertion direction of the terminal fitting. A leak prevention rib preferably projects out from the outer wall of the housing between the openings in the outer wall of the housing at the front ends of the cavities.

The leak prevention rib enables an increase in the distance along which water would have to creep between the cavities. Thus, if the connector is exposed to water, it is possible to prevent a short circuit current from being generated between the cavities due to the leaked water. The leak prevention rib is formed only at the position between the cavities. Thus the leak prevention rib hardly interferes with the peripheral edge of the through-hole, and enables the formation of a small through-hole.

DETAILED DESCRIPTION OF THE PREFERRED EMBODIMENTS

Figure 1:
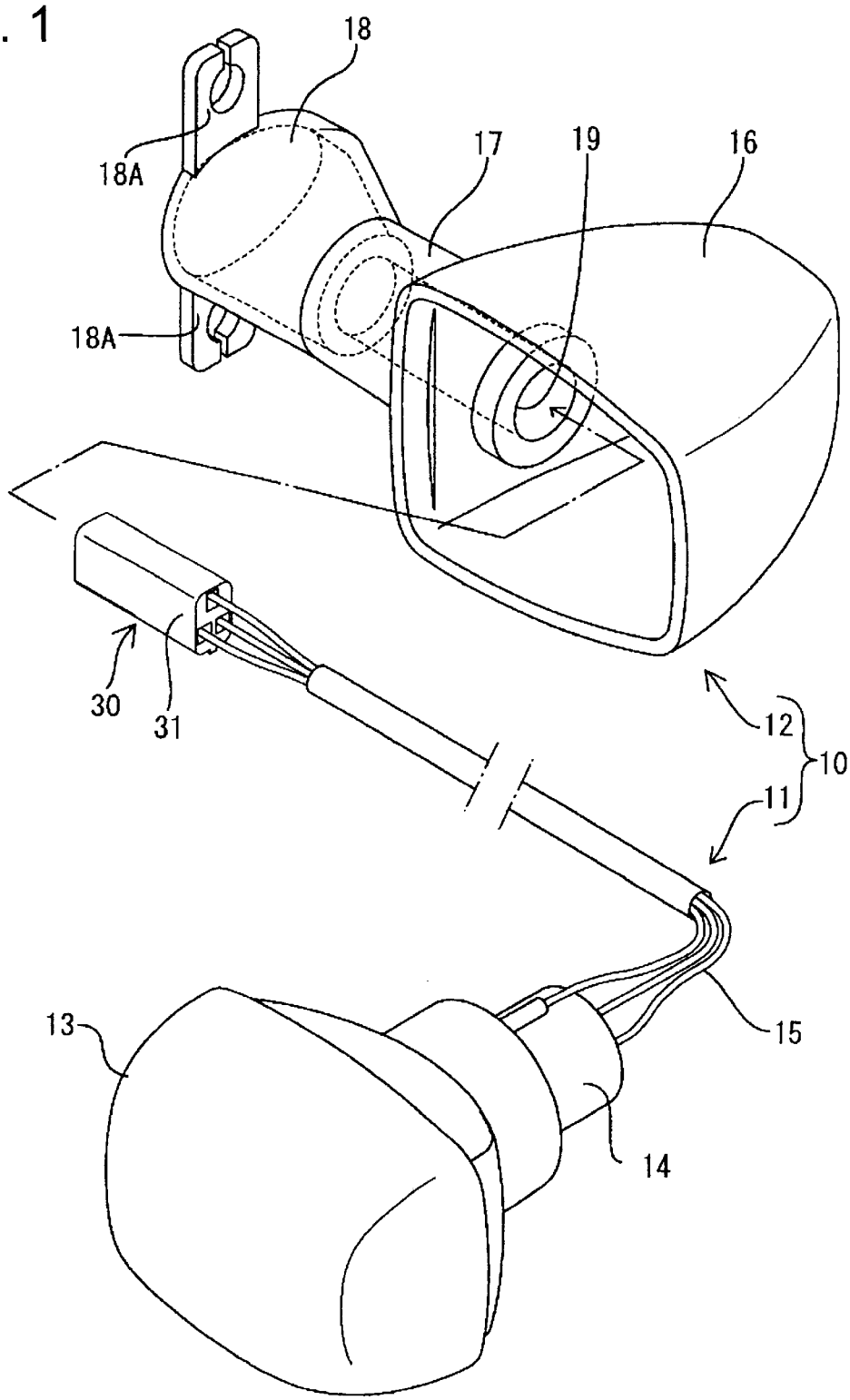
FIG. 1 is a perspective view showing a winker in an embodiment of the present invention.

FIG. 1 shows a blinker 10 of an automatic two-wheeled vehicle in which a connector 30 of the subject invention is used. The blinker 10 includes a lamp body 11 and a lamp holder 12.

The lamp body 11 has a light emitter 13 at its front end and a lamp socket 14 is disposed inside the light emitter 13. Three electric wires 15 extend from the lamp socket 14. A female terminal fitting 20 (see FIG. 2) is connected to an end of each electric wire 15 remote from the lamp socket 14. The female terminal fitting 20 is mounted in the connector 30.

The lamp holder 12 is made of a synthetic resin and has a forwardly open cup-shaped holder 16. A cylindrical neck 17 has one end connected to a side surface of the cup-shaped holder 16. A flared mounting part 18 has a narrow end connected to the end of the neck 17 remote from the cup-shaped holder 16. A circular through-hole 19 is formed through the neck 17. One end of the through-hole 19 is open in the cup-shaped holder 16, whereas the other end of the through-hole 19 communicates with the mounting part 18. Two flat screw flanges 18A project from the wide end of the mounting part 18. The lamp holder 12 is fixed to the vehicle body by passing screws (not shown) through the screw flanges 18A and into the vehicle body. The lamp body 11 is mounted inside the cup-shaped holder 16 by disposing the socket 14 at the inner side of the cup-shaped holder 16. The connector 30 is inserted through the through-hole 19 of the neck 17 and is connected to a mating male connector 50 on the vehicle body, as described below.

Figure 2:
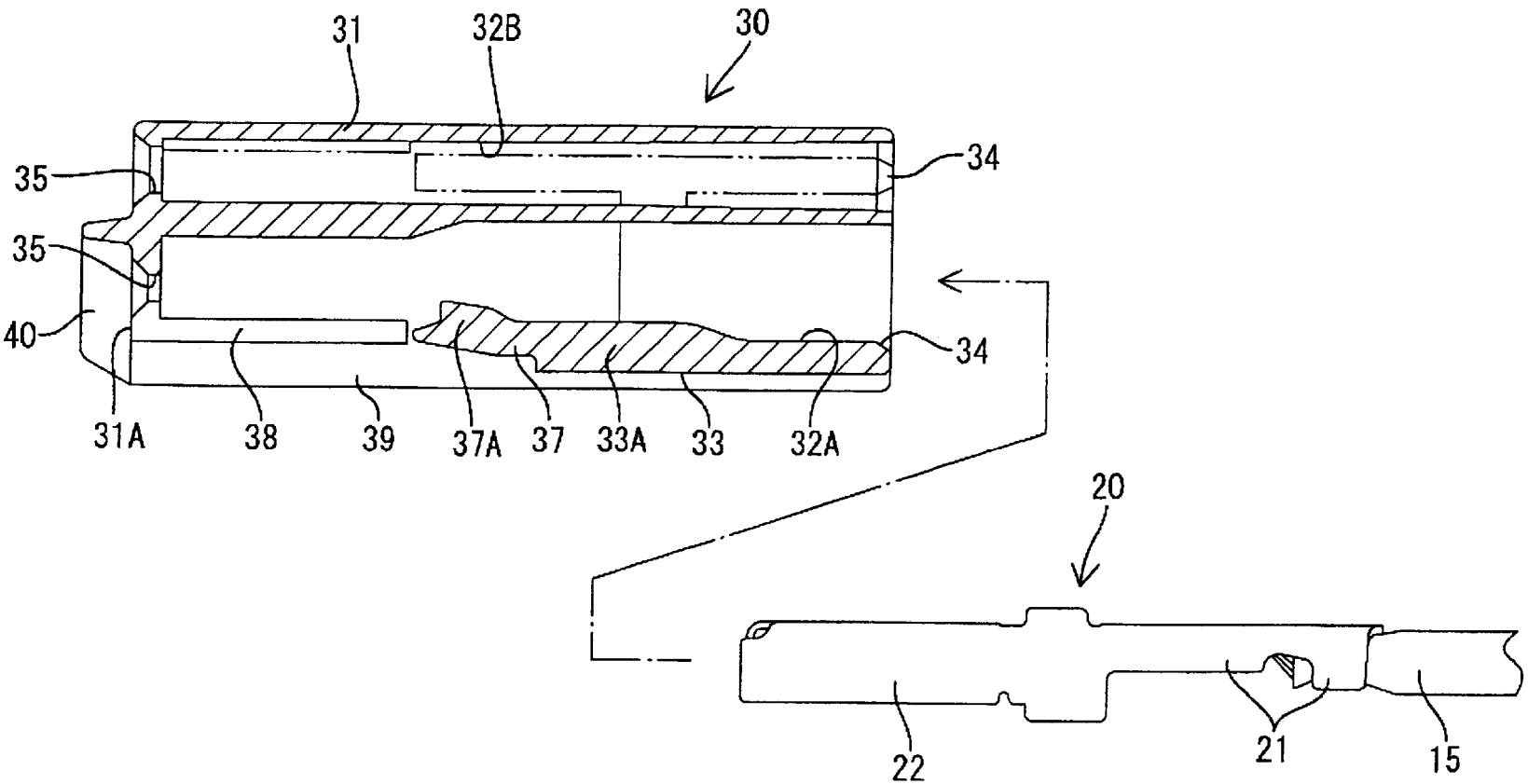
FIG. 2 is a side sectional view showing a state before a female terminal fitting is inserted into a housing.
Figure 4:
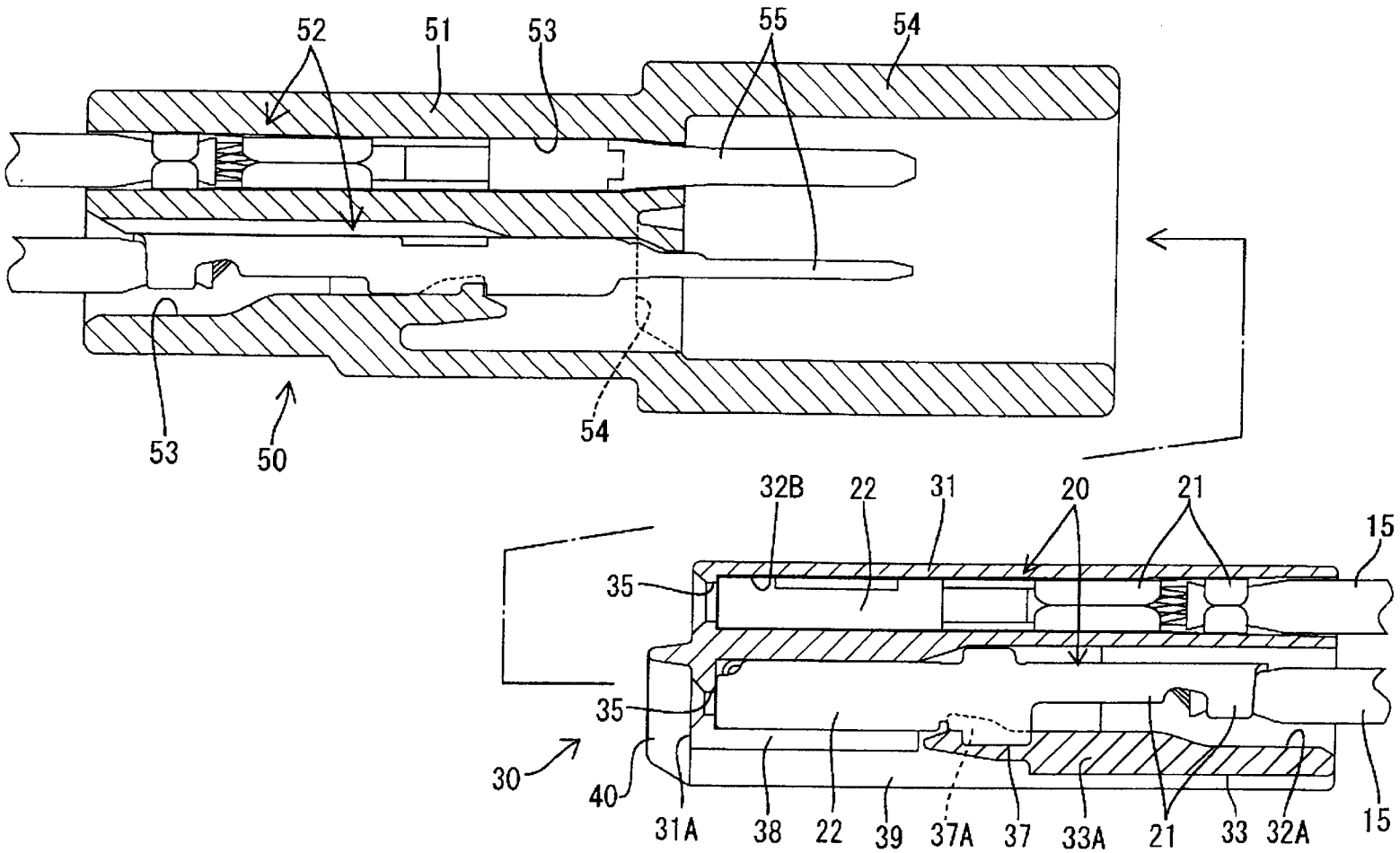
FIG. 4 is a side sectional view showing a state before a connector is inserted into a male connector.
Figure 6:
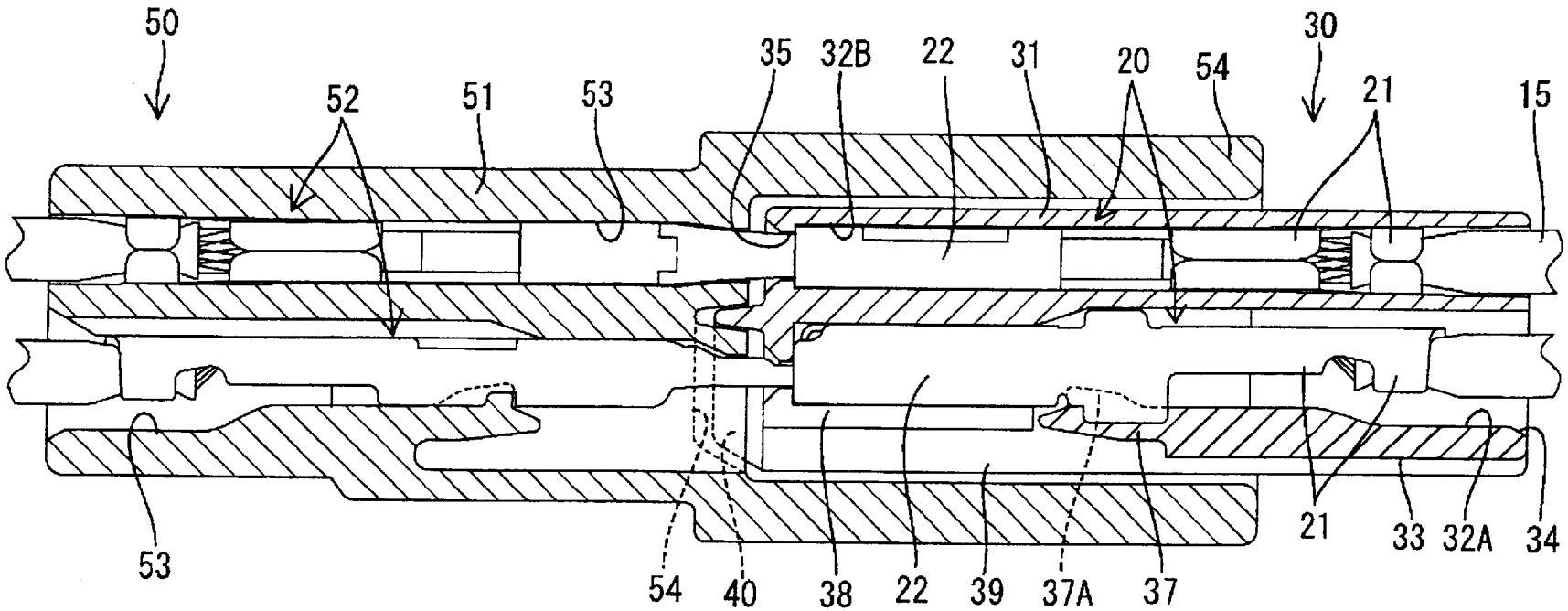
FIG. 6 is a side sectional view showing a state in which the connector has fitted on the male connector.
Figure 7:
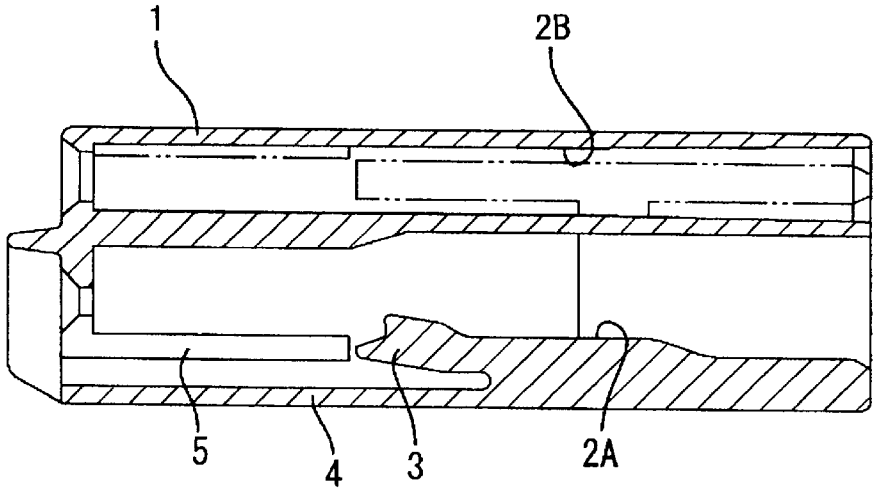
FIG. 7 is a side sectional view showing a conventional housing.
Figure 8:
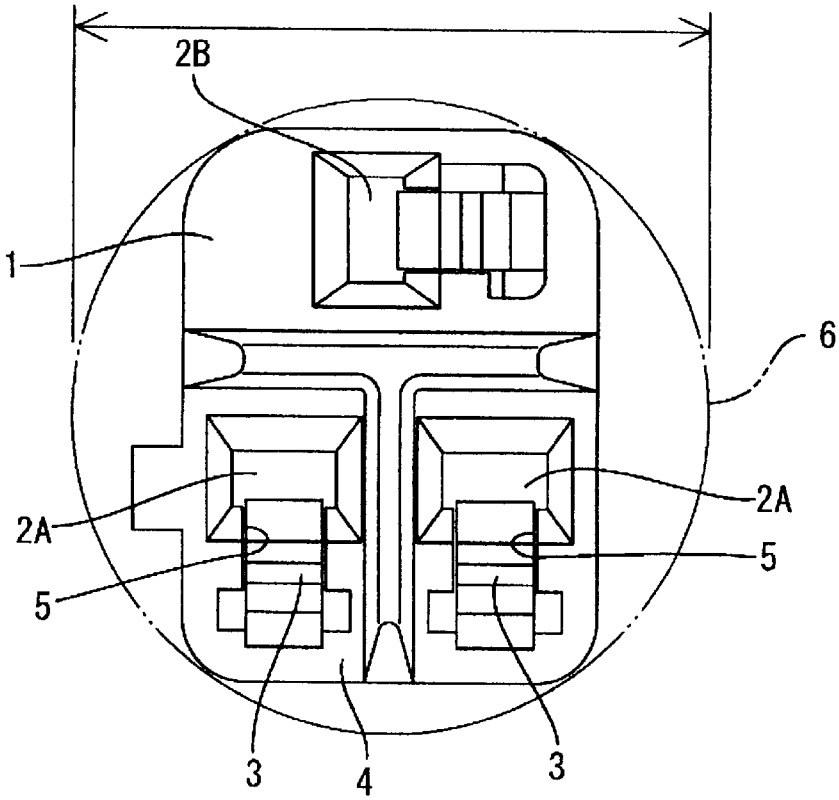
FIG. 8 is a front view showing the conventional housing.

The female terminal fitting 20 is made of a conductive metal plate material, and has opposed front and rear ends. A barrel 21 is formed at the rear end of the female terminal fitting 20 and can be caulked or crimped into connection with the end of the electric wire 15, as shown in FIGS. 2 and 4. An approximately quadrangular cylindrical connection part 22 is formed at the front end of the female terminal fitting 20, and has an open front end for receiving a tab 55 of a male terminal fitting 52, as shown in FIGS. 4 and 6. An elastic contact piece (not shown) is provided inside the connection part 22 and contacts the tab 55 elastically so that the female terminal fitting 20 and the male terminal fitting 52 become electrically conductive to each other.

Figure 3:
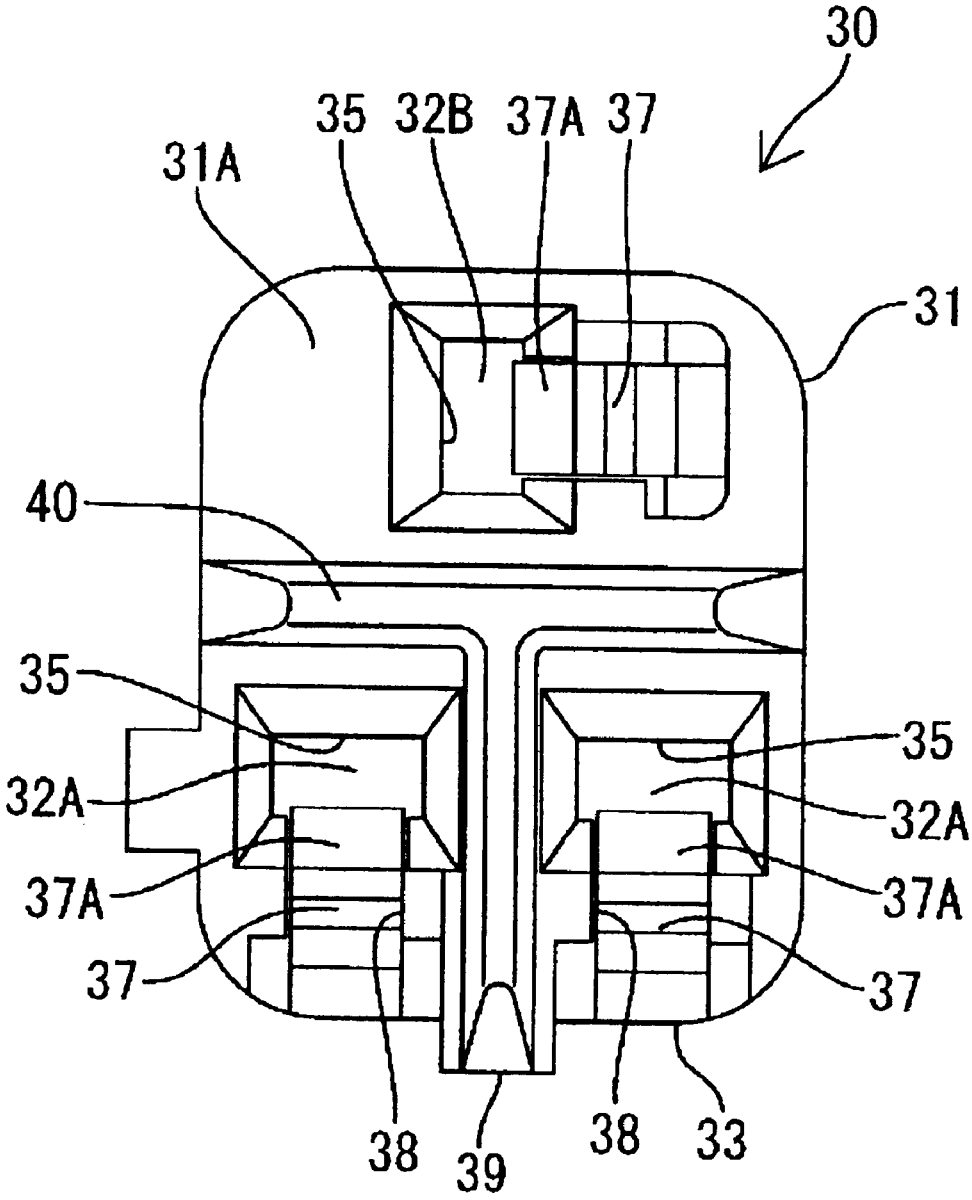
FIG. 3 is a front view showing the housing.

As shown in FIGS. 2 and 3, the connector 30 has a long narrow rectangular housing 31 made of a synthetic resin. The left side of the housing 31 in FIG. 2 is referred to herein as the front end. Three cavities 32A, 32A, and 32B are provided inside the housing 31 and are configured for accommodating the female terminal fittings 20. The cavities 32A and 32A are arranged side by side along a lower exterior wall 33 of the housing 31. The remaining cavity 32B is formed on an upper portion of the housing 31. The longitudinal axes of the cavities 32A, 32A and 32B are substantially parallel. However, the cavity 32B is effectively rotated ninety degrees about its axis with respect to the orientation of the cavities 32A and 32A. Each of the cavities 32A and 32B has a terminal insertion opening 34 at the rear end of the housing 31 for receiving the female terminal fitting 20. Each of the cavities 32A and 32B also has a tab insertion opening 35 at the front end of the housing 31 for receiving the tab 55 of the male terminal fitting 52. The tab insertion opening 35 is cross-sectionally smaller than the terminal insertion opening 34.

A resiliently deflectable lance 37 is disposed in a longitudinal center of each of the cavities 32A and 32B and is cantilevered toward the front of the respective cavity 32A, 32B. The lance 37 of the upper cavity 32B is formed on a side surface of the upper cavity 32B, and hence the front end of the lance 37 of the upper cavity 32B is flexible in a right-to-left direction. The lance 37 of each lower cavity 32A is formed continuously with a lower wall 33 of the housing 31, and the front end of the lance 37 in each lower cavity 32A is flexible in a vertical direction. Each lance 37 has a locking projection 37A projecting from its front end toward the inside of each of the cavities 32A and 32B. The female terminal fitting 20 can be held in the respective cavity 32A, 32B by locking the locking projection 37A to the rear edge of the connection part 22 of the female terminal fitting 20.

The lower wall 33 is formed only in the rear half region of the housing 31. The lower wall 33 includes a lance base 33A that is continuous with the base portion of the lance 37. The lance base 33 is a little thicker than other portions of the lower wall 33. The housing 31 has an open part 38 disposed forward from the lance base 33A. The open part 38 extends from the lance base 33A to a front surface 31A of the housing 31 and serves as a drawing opening for drawing a die forward when the lance 37 is molded.

A rib 39 projects from the lower surface of the housing 31 and extends over the entire length of the housing 31. A rear part of the rib 39 is disposed below the lower wall 33 and a front part of the rib 39 projects between the open parts 38 of the adjacent lower cavities 32A and 32A. A T-shaped rib 40 is formed on the front surface 31A of the housing 31 in such a way that the rib 40 partitions the cavities 32A and 32B from each other. The ribs 39 and 40 define a distance between the cavities 32A and 32B along which water would have to creep or seep between the cavities 32A and 32B.

As shown in FIG. 4, the male connector 50 has a male housing 51 made of a synthetic resin. Three cavities 53 are provided inside the male housing 51 and are dimensioned to accommodate male terminal fittings 52. A hood 54 is formed at the front of the male housing 51 and is dimensioned to fit over the front of the housing 31, including the open portion 38 of the housing 31. Each male terminal fitting 52 has a tab 55 that projects inside the hood 54. A T-shaped groove 56 is formed on the rear surface of the hood 54 and is capable of receiving the rib 40 on the front surface of the housing 31.

The female terminal fittings 20 connected to the ends of the three electric wires 15 are taken out from the lamp body 11 and are inserted into the cavities 32A and 32B of the housing 31. This insertion causes the connection part 22 of each female terminal fitting 20 to strike against the locking projection 37A of the lance 37. As a result, the front end of the lance 37 flexes. When each female terminal fitting 20 is moved to a normal mounting position, the lance 37 returns to its original state, and the locking projection 37A is locked to the rear end of the connection part 22. Thus the female terminal fittings 20 are locked in the cavities 32A and 32B.

Figure 5:
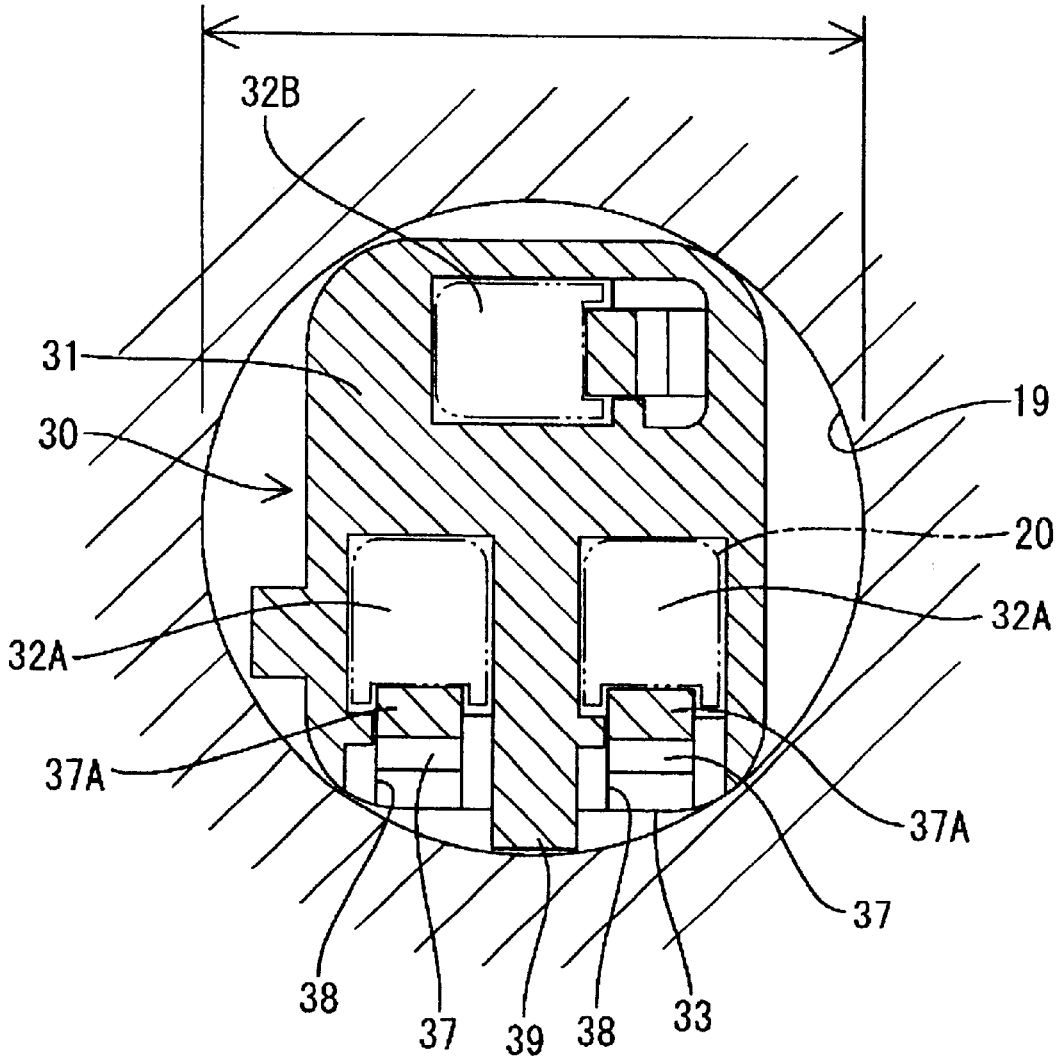
FIG. 5 is a front sectional view showing a state in which the connector is inserted into a through-hole.

The lamp holder 12 is mounted on the vehicle body, and the connector 30 is inserted into the through-hole 19 from the opening of the cup-shaped holder 16. The housing 31 then is inserted longitudinally into the through-hole 19 from the front end thereof. As a result, as shown in FIG. 5, the housing 31 penetrates into the through-hole 19, with slight gaps formed between the inner peripheral surface of the through-hole 19 and the four corners of the housing 31 as well as the front end of the rib 39. More particularly, the four corners of the housing 31 and the rib 39 define points on a circle that has a diameter slightly smaller than the through-hole 19. The connector 30 is inserted into the through-hole 19 and taken out from the opening at the opposite side. The connector 30 then is fitted on the hood 54 of the male connector 50 on the vehicle body. In the fit-on state, as shown in FIG. 6, the tab 55 of the male terminal fitting 52 is inserted into the connection part 22 of the female terminal fitting 20. Consequently the female terminal fitting 20 and the male terminal fitting 52 become electrically conductive to each other. Additionally, the T-shaped rib 40 is received in the groove 56, and the outer side (lower side) of the open part 38 of the housing 31 is covered with the hood 54. In this manner, the assembling operation is completed.

The lower wall 33 of the housing 31 forward from the lance 37 is formed as the open part 38. Thus, it is possible to make the entire lower wall 33 thinner than a conventional lower wall. Therefore the housing 31 can be inserted into the smaller through-hole 19.

The rib 39 projects between the open parts 38 corresponding to the adjacent cavities 32A and 32A. Therefore, it is possible to increase the creeping distance that water would have to travel between the cavities 32A and 32B. Thus, if the connector 30 is exposed to water, it is possible to prevent water flow and any short circuiting current from being generated through the water between the cavities 32A and 32A. The rib 39 projects only the position intermediate between the cavities 32A and 32A. Thus the rib 39 hardly interferes with the peripheral edge of the through-hole 19, and the through-hole 19 can be small.

The technical scope of the present invention is not limited to the above-described embodiment, but the following construction is included in the technical scope of the present invention.

In the above-described embodiment, two cavities are formed along the outer wall of the housing at the side where the open part is formed. However in the present invention, only one cavity or more than two cavities may be formed side by side along the outer wall of the housing at the side where the open part is formed. If more than two cavities are formed side by side along the outer wall of the housing at the side where the open part is formed, the leak prevention rib may be formed in the space between the open parts corresponding to the adjacent cavities.

What is claimed is:

1. A connector comprising: a housing having a front end and an opposite rear end and a plurality of cavities extending between the front end and the rear end, the housing having an external wall defining parts of the cavities, the external wall extending substantially from the rear end of the housing to a base between the front end and the rear end, such that each of said cavities defined by the external wall is open from the base to the front end, lances cantilevered forwardly in the respective cavities from the base of the external wall toward the front end of the housing, a leak-preventing rib extending outwardly beyond the external wall and forwardly substantially to the front end of the housing at a location between the cavities.

2. The connector of claim 1, wherein the cavities have longitudinal axes defining terminal insertion directions, the leak-preventing rib defining a plane substantially parallel to the axes of the cavities.

3. The connector of claim 2, wherein portions of the housing spaced from the leak-preventing rib define a substantially polygonal cross-section with a plurality of walls intersecting at corners, the corners and the leak-preventing rib defining points on a common circle.

4. The connector of claim 2, wherein the housing is molded unitarily from a synthetic resin.

5. The connector of claim 2, further comprising terminal fittings locked in the respective cavities by the lances.

6. The connector of claim 5, further comprising a mating connector having a housing with a hood telescoped over the housing from the front end to the base and covering the portion of each said cavity that is open.

* * * * *